US005920924A

United States Patent [19]

Pinciaro

[11] Patent Number: 5,920,924

[45] Date of Patent: Jul. 13, 1999

[54] HYDROTHERAPY JET AND FIXTURES FOR SPA TUBS AND POOLS AND A METHOD OF INSTALLATION

[76] Inventor: John Pinciaro, 451 Moose Hill Rd., Monroe, Conn. 06468

[21] Appl. No.: 08/967,761

[22] Filed: Nov. 10, 1997

[51] Int. Cl.[6] ..... A61H 33/04

[52] U.S. Cl. ..... 4/541.6; 4/541.1; 4/541.4; 4/492; 277/606

[58] Field of Search ..... 4/492, 541.1–541.6; 277/606, 607, 634, 637, 644, 648; 285/80, 95, 110, 113, 196, 220, 139.2

[56] References Cited

U.S. PATENT DOCUMENTS

| | | | |
|---|---|---|---|
| D. 318,900 | 8/1991 | Zarinfar | D23/213 |
| 3,953,555 | 4/1976 | Gley | 261/124 |
| 4,261,347 | 4/1981 | Spencer, III | 128/66 |
| 4,359,790 | 11/1982 | Chalberg | 4/541 |
| 4,419,775 | 12/1983 | Ebert | 4/542 |
| 4,429,886 | 2/1984 | Buttner | 277/606 |
| 4,460,519 | 7/1984 | Leggett | 261/76 |
| 4,475,578 | 10/1984 | Nidle | 152/415 |
| 4,544,996 | 10/1985 | George | 362/238 |
| 4,553,299 | 11/1985 | Ebert | 29/157 |
| 4,581,781 | 4/1986 | Ebert | 4/542 |
| 4,613,169 | 9/1986 | Engelhart | 285/161 |
| 4,715,071 | 12/1987 | Henkin et al. | 4/542 |
| 4,782,430 | 11/1988 | Robbins et al. | 362/32 |
| 5,014,372 | 5/1991 | Thrasher et al. | 4/542 |
| 5,029,879 | 7/1991 | Strang, Sr. et al. | 277/178 |
| 5,045,978 | 9/1991 | Gargle | 362/101 |
| 5,056,156 | 10/1991 | Mersmann | 4/452 |
| 5,076,500 | 12/1991 | Daniels | 239/587 |
| 5,207,499 | 5/1993 | Vajda et al. | 362/96 |
| 5,217,292 | 6/1993 | Chalberg | 362/96 |
| 5,265,286 | 11/1993 | Filipponi | 4/541 |
| 5,291,621 | 3/1994 | Mathis | 4/541.4 |
| 5,353,447 | 10/1994 | Gravatt | 4/541.6 |
| 5,466,016 | 11/1995 | Briody et al. | 277/606 |
| 5,495,627 | 3/1996 | Leaverton et al. | 4/541.6 |
| 5,638,874 | 6/1997 | Thompson | 141/301 |

FOREIGN PATENT DOCUMENTS

| | | | |
|---|---|---|---|
| 454029 | 10/1991 | European Pat. Off. | 4/541.6 |
| 1282648 | 12/1961 | France | 277/606 |
| 3720637 | 6/1988 | Germany | 4/541.6 |

*Primary Examiner*—Henry J. Recla
*Assistant Examiner*—Tuan Nguyen
*Attorney, Agent, or Firm*—David P. Gordon; David S. Jacobson; Thomas A. Gallagher

[57] ABSTRACT

A spa fixture assembly includes a resilient grommet, a fixture body (e.g., a jet valve body), and a fixture cartridge (e.g., a combined jet valve and cover). The grommet has a body having an inner surface and an outer surface and a lip, with the inner surface preferably tapering away from the lip. The fixture body has a water entry port, an air conduit, a lip, and a threaded insert holder. The fixture cartridge includes a body having external threads, a front peripheral cover, and an insert (e.g., a jet valve). The grommet is inserted from either the front or back of a tub through a hole drilled in a tub wall until the lip of the grommet seats flush with the tub wall. The fixture body is inserted through the grommet (towards the tapered end of the grommet) from the back of tub until the lip of the fixture body seats against the lip of the grommet and is thereby interference fit within the grommet. The fixture cartridge is thread into the fixture body from the front of tub (i.e., from inside the tub), and the peripheral cover portion cosmetically covers the portions of the grommet and fixture body which extend through the tub wall, and further locks the fixture body in place.

23 Claims, 6 Drawing Sheets

HYDROTHERAPY JET AND FIXTURES FOR SPA TUBS AND POOLS AND A METHOD OF INSTALLATION

This application relates to U.S. Ser. No. 08/682,432, which is hereby incorporated by reference herein in its entirety.

BACKGROUND OF THE INVENTION

1. Field of the Invention

This invention relates broadly to hot tub, spa, jetted bathtub, and swimming pool fixtures. More particularly, this invention relates to hot tub, spa, jetted bathtub, and swimming pool fixtures especially of a hydrotherapy jet system type which are easily and quickly installable.

2. State of the Art

Hot tubs and spas are generally relatively deep rotationally-molded, blow-molded or vacuum-formed tubs having an acrylic gelcoat interior surface and a relatively rougher fiberglass back. The tubs are provided with a number of fixtures including water jet assemblies. The appeal of hot tubs and spas is primarily due to the hydrotherapy provided by pressurized water jet fixtures recessed into the tub wall which provide a massaging action.

In particular, each hydrotherapy jet assembly is connected to a pressurized water supply and an air supply. The pressurized water flows through a hydrotherapy jet assembly having an expanded nozzle. As the water flows through the expanded nozzle, the water at the center of the nozzle moves more rapidly than the water along the sides of the nozzle. As a result, a low pressure area is created at the center of the nozzle. Air is drawn from an inlet into the low pressure area and mixes with the water. The mixture of pressurized water and air thereby provide an aerated therapeutic jet of water.

Well-known hydrotherapy jet assembly fixtures (e.g., those available from Jacuzzi Bros.) generally include four components: a wall fitting, a gasket, a jet valve body, and caulk. A first step in installing a jet assembly is drilling a hole in the tub wall from the inside of the tub through to the back of the tub at the desired location of the fixture. Next, the back of the tub surrounding the drill site must be ground smooth, flat, and parallel to the interior of the tub. This grinding is done by eye and introduces a margin for potential error into the installation. The gasket is placed onto the wall fitting, and the wall fitting is inserted through the drill hole from the interior of the tub, such that the gasket is between the wall fitting and the interior surface of the tub. The jet valve body is then attached to the portion of the wall fitting exiting the back of the tub. However, the tubs are relatively deep. Therefore, two persons are required to install the fixture in the tub. One person holds the wall fitting stationary from the interior of the tub, while the other person threads the jet valve body onto the wall fitting from the back of the tub such that the wall fitting and the jet valve body sandwich the tub wall. A bead of caulk seals the jet valve body to the back of the tub wall. The jet assembly is then connected to a water conduit and an air conduit.

This method of installation using the available hydrotherapy jet fixtures is cumbersome and inefficient primarily because it requires two persons to install. Similar problems are faced when installing other fixtures into the wall of a spa tub or a pool, as they are often installed in a manner similar to the hydrotherapy jet fixture. The prior art requires a substantial amount of skill to properly install the fixtures.

SUMMARY OF THE INVENTION

It is therefore an object of the invention to provide a tub or pool fixture assembly which is easy to install.

It is another object of the invention to provide a tub or pool fixture assembly which does not require significant skill to install.

It is a further object of the invention to provide a tub or pool fixture assembly which has a smaller potential margin for error on installation.

It is also an object of the invention to provide a tub or pool fixture assembly which has a fixture body which can be installed from the rear wall side of the tub or pool.

It is an additional object of the invention to provide a tub or pool fixture assembly which can be installed by a single person.

It is a further object of the invention to provide a tub or pool fixture assembly which has fewer components.

It is still another object of the invention to provide a tub or pool fixture assembly which is reliable.

It is still a further object of the invention to provide a tub or pool fixture assembly which does not require the use of sealants, adhesives, gaskets, or o-rings.

In accord with these objects which will be discussed in detail below, a hot tub, spa, or pool fixture assembly is provided which has fewer component parts and which can relatively easily be installed by one person and in fewer installation steps than the prior art.

According to the preferred embodiment of the invention, a hydrotherapy fixture assembly includes a resilient grommet, a fixture body (e.g., a jet valve body), and a fixture cartridge (e.g., a combined jet valve insert and fixture body cover). The grommet has a body having an outer surface, a tapered inner surface and a rear lip, with the tapered inner surface preferably narrowing as it extends away from the rear lip. The grommet is optionally provided with a raised bead running the circumference of its inner surface. The fixture body has a water entry port, an air conduit, an internally threaded holder portion, a lip rearward of the front of the holder portion, and, if a bead is provided to the grommet, the body has an external circumferential groove for engagement with the raised bead of the grommet. The fixture may also have a barbed external surface on the front of the holder portion. The fixture cartridge includes a body having external threads, a front peripheral cover, and an insert (e.g, a jet valve) seated in the body.

According to a preferred method of the invention, the grommet is inserted from either the front or the back of the tub through a hole drilled in a tub wall until the lip of the grommet seats flush with the tub wall. The fixture body is inserted through the grommet (towards the tapered end of the grommet) from the back of the tub until the peripheral lip of the fixture body seats against the rear lip of the grommet creating an interference fit within the grommet. If the grommet includes a raised bead and the fixture body is provided with a circumferential groove, the bead and groove are positioned on their respective components such that when the fixture body is seated within the grommet, the bead seats within the groove and further secures the fixture body in the grommet. Once the fixture body is securely installed in the tub wall, a fixture cartridge is thread into the fixture body from the front wall side of the tub (i.e., from inside the tub), and the peripheral cover portion cosmetically covers the portions of the grommet and fixture body which extend through or are visible through the tub wall, and further locks the fixture body in place.

With this design and method of installation, no back grinding is required of the drilled hole and no other sealant, such as a gasket, caulking, or o-ring, is required for installation. It will be further appreciated that a system is provided which permits easy installation into a tub wall, as installation can be performed in tub walls of various thicknesses and having uneven or rough surfaces with no surface preparation other than drilling the correct size hole. In addition, relatively fewer component parts are required than with other fixtures. Moreover, by having a fixture body that can be installed from the rear, the rear portion of the fixture body can be relatively larger in outer dimension than the inner diameter of the grommet, and, as such, there are relatively few design constraints with respect to the size and shape of the fixture body. Also importantly, the installation of the fixture assembly may be completed by one person, or may be readily adaptable for robotic assembly.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
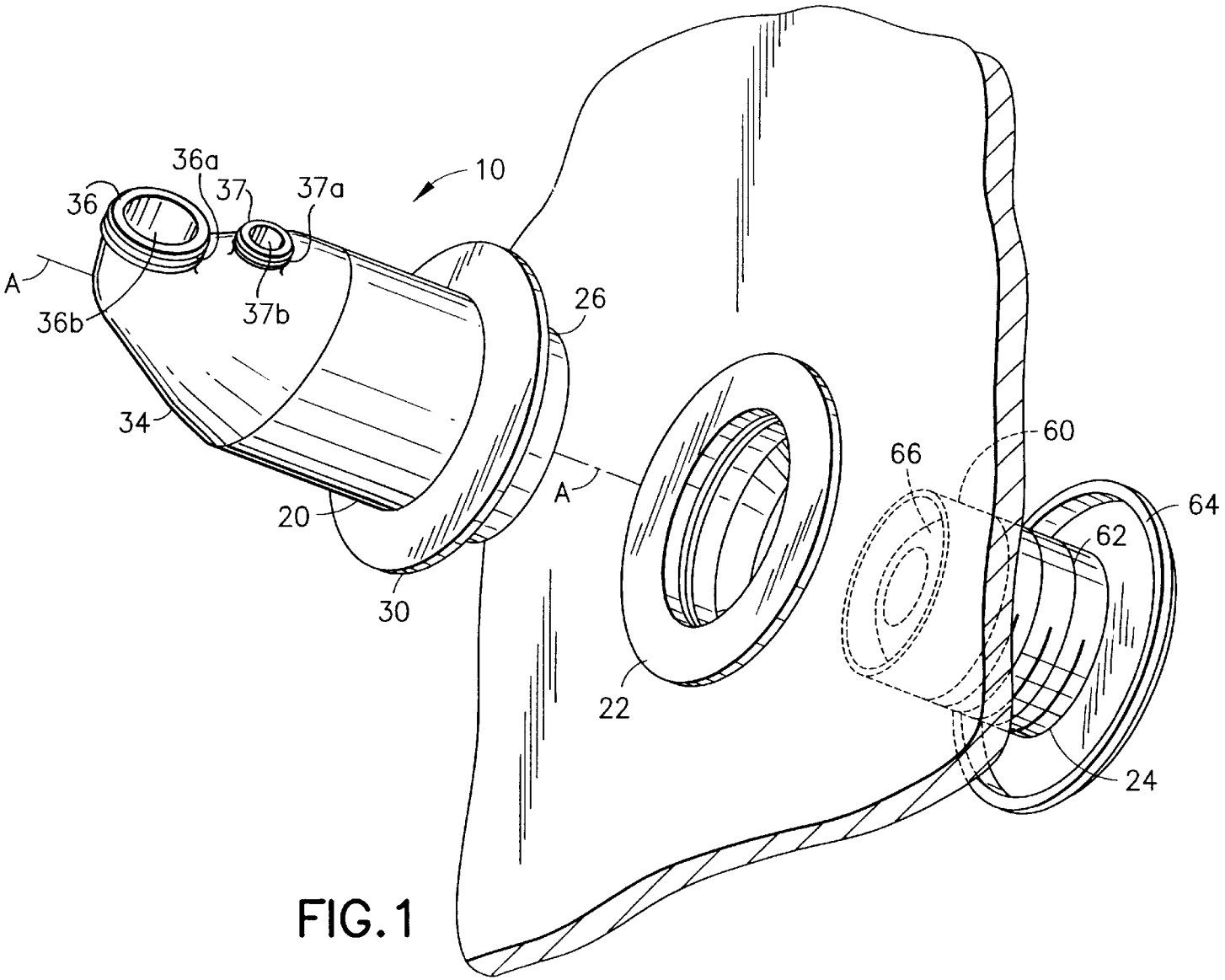
FIG. 1 is an exploded perspective view of a tub fixture assembly according to a first embodiment of the invention.
Figure 2:
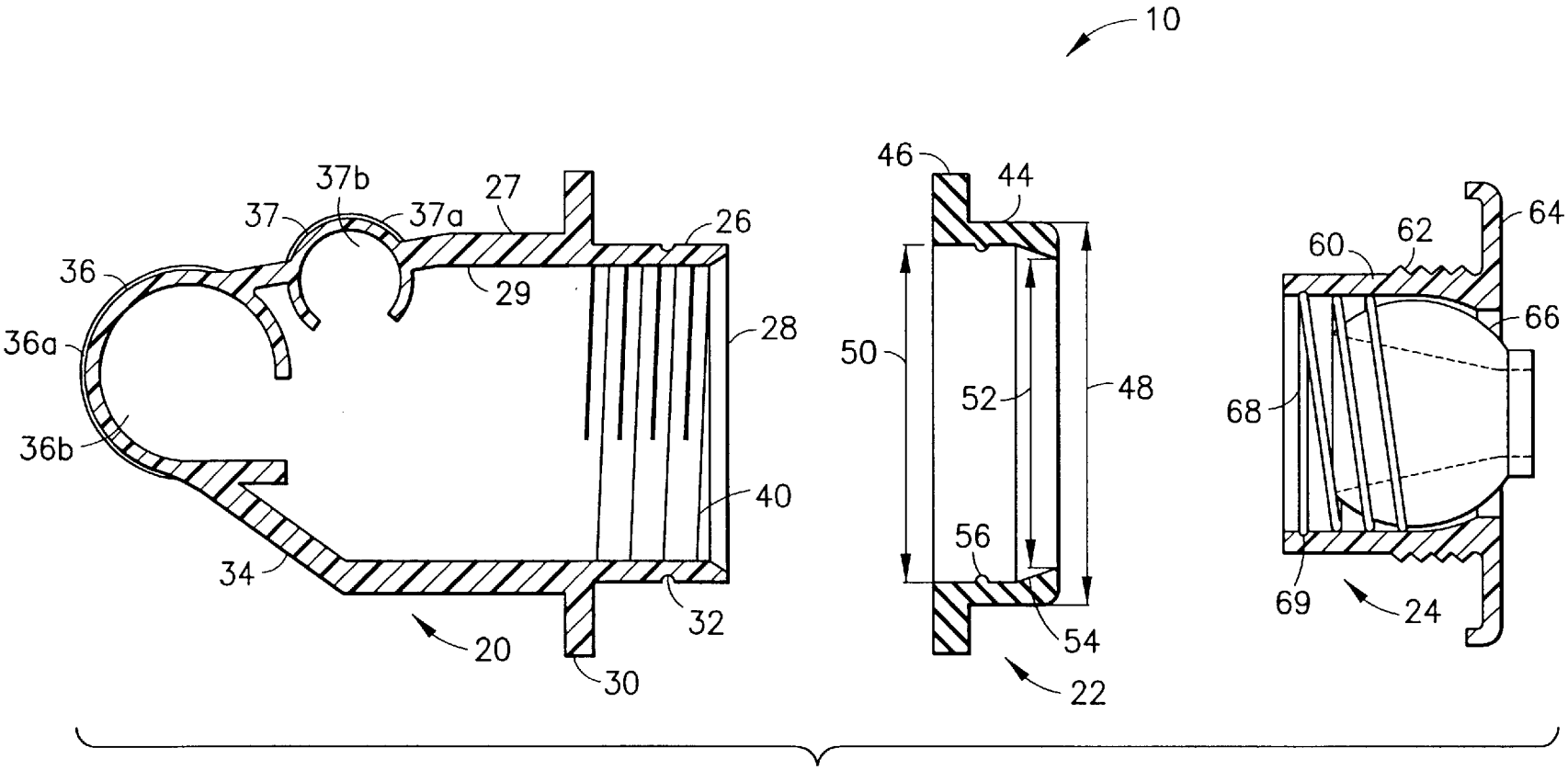
FIG. 2 is an exploded side elevation view in section of the embodiment of FIG. 1.

Turning now to FIGS. 1 and 2, a spa tub fixture assembly in the form of a hydrotherapy jet assembly 10 is shown. The hydrotherapy jet assembly 10 generally includes a jet valve body 20, a wall grommet 22, and a fixture cartridge 24. The jet valve body 20, preferably made from schedule #40 PVC, is generally molded to include a front portion 26 with an opening 28, a rear portion 27, an inner surface 29, a peripheral lip 30 rearward of the opening 28, a generally frustoconical portion 34, and optionally an external circumferential groove 32. The frustoconical portion 34 has a water entry port 36 and an air conduit 37, each preferably having a barbed portion 36*a*, 37*a* for coupling the jet valve body 20 to water and air sources, respectively. In addition, the water entry port 36 and the air conduit 37 each have their respective opening 36*b*, 37*b* preferably oriented perpendicular (but not necessarily co-planar) to the axis A of the jet valve body (FIG. 1). The inner surface 29 at the front portion 26 of the jet valve body 20 is provided with threads 40 engageable by the fixture cartridge 24, as described below.

The wall grommet 22 is made of a resilient material, such as rubber, and includes a body 44 and a rear lip 46. Forward of the rear lip 46, the body 44 has an outer diameter 48 which is preferably substantially constant and an inner diameter 50 which preferably tapers to a smaller inner diameter 52 at the front 54 of the body. The grommet 22 is optionally provided with a raised bead 56 extending around its inner circumference.

The fixture cartridge 24, preferably also made from schedule #40 PVC, includes a body 60 having external threads 62 which mate with the internal threads 40 on the front portion 26 of the jet valve body 20. The body 60 of the fixture cartridge 24 also includes a front peripheral cover 64 and a directable jet valve insert 66 held within, yet rotatable within, the body. The insert 66 may be held in the cartridge 24 with a spring 68 secured by a retaining groove 69 at the rear of the cartridge, snap fit into the body 60, or otherwise secured within the body 60.

Figure 3:
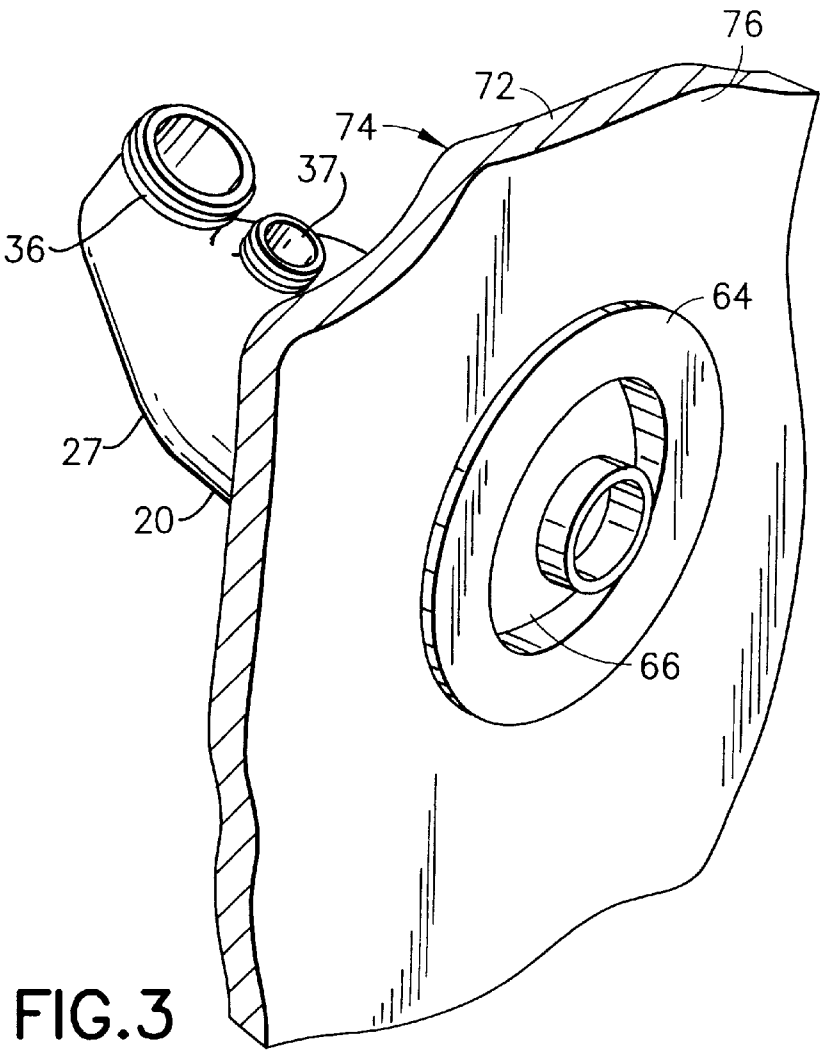
FIG. 3 is a perspective view of the assembled tub fixture assembly according to the first embodiment of the invention.
Figure 4:
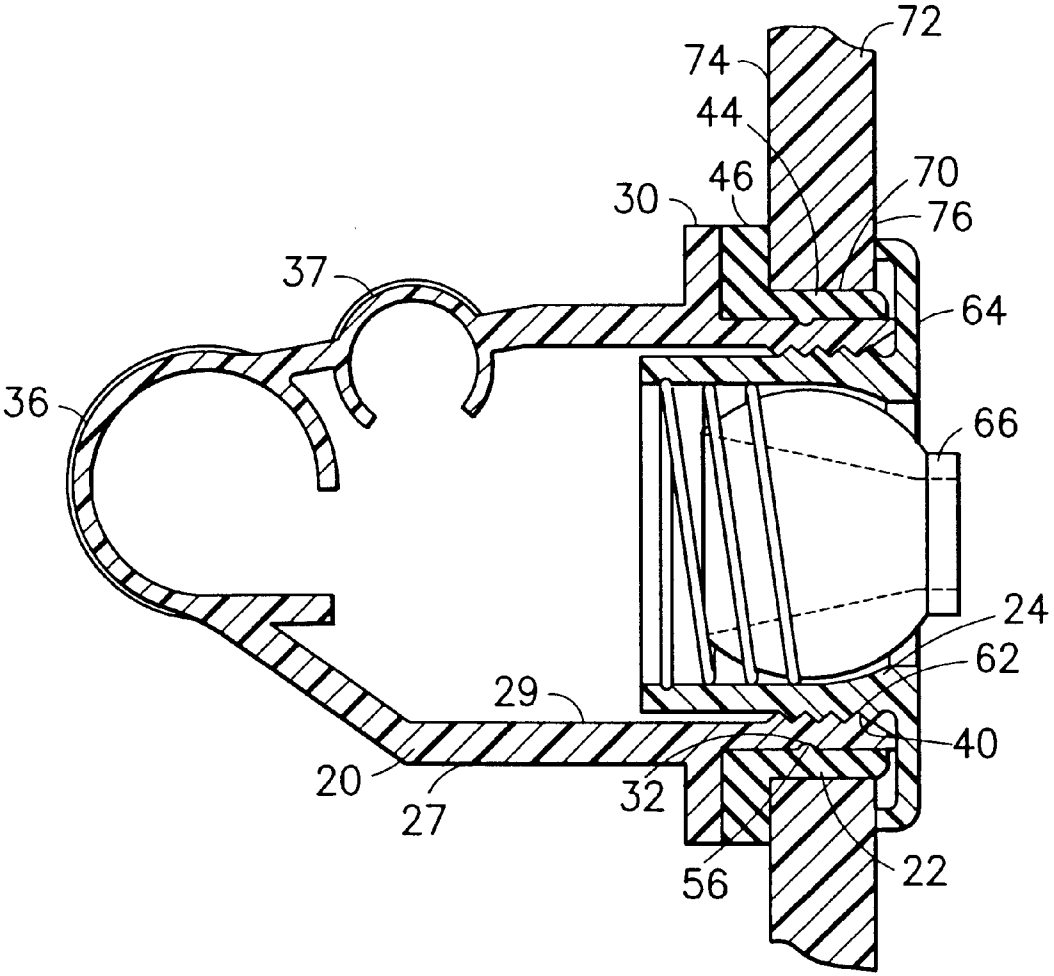
FIG. 4 is a section view of the assembled tub fixture assembly according to the first embodiment of the invention.

Turning to FIGS. 3 and 4, the hydrotherapy jet assembly 10 is installed as follows. A hole 70, approximately the size of the outer diameter 48 of the wall grommet 22 (FIG. 2), is drilled into a tub or pool wall 72. From the back 74 of the wall 72, and without having to first grind back the fiberglass backing, the wall grommet 22 is seated into the hole 70 such that the body 44 of the grommet 22 partially passes through the tub wall with the rear lip 46 of the grommet seating substantially flush against the back 74 of the tub wall. Optionally, a small amount of lubricant, e.g., soapy water, is coated over the inner opening of the grommet 22; i.e., within the area surrounded by the rear lip of the grommet. The lubricant is chosen to be one that will not break down the material of the wall grommet 22 or the jet valve body 20. The jet valve body 20 is pushed through the wall grommet until the peripheral lip 30 on the jet valve body 20 is seated flush against the rear lip 46 of the grommet and, if the groove 32 and bead 56 are provided, until the groove 32 is engaged by the bead 56. It is not necessary to apply caulking to the wall grommet to create a watertight seal as the insertion of the jet valve body into the wall grommet will compress the wall grommet and automatically create a watertight seal between the jet valve body 20 and the tub wall 72. Plumbing fittings (not shown) for water lines and air lines can then be interference fit with the barbs at the respective openings of the water conduit 36 and air conduit 37. From the front 76 of the wall; i.e., from inside the tub, the fixture cartridge 24 is inserted into the jet valve body 20 by threading external threads 62 on the fixture cartridge into the internal threads 40 of the jet valve body such that the fixture cartridge is held in the jet valve body. Once the fixture cartridge is properly inserted, when viewed from the interior of the tub or pool, the front peripheral cover 64 will cosmetically cover and conceal any formerly exposed portions of the jet valve body 20 and the grommet 22. The cover 64, being larger in diameter than the hole 70 in the tub wall, further prevents any rearward migration of the jet valve body relative to or together with the grommet.

From the foregoing, it will be appreciated that water flows from the water supply to the water conduit 36 of the jet valve body 20. As the water expands from the relatively narrow water entry port through the generally frustoconical portion 34 (nozzle) and out the front portion 26 of the body 20, the water at the center section of the body flows at a higher velocity and creates a pressure differential, such that a vacuum is formed. During operation, sufficient vacuum force inside the jet valve body will draw air in through the air conduit 37. The air mixes with the water and creates a therapeutic jet. As is known in the art, the jet can be controlled by the jet valve insert 66 of the fixture cartridge which directs and moderates the flow of the jet.

It will be appreciated that fewer components are required for the spa jet assembly of the invention than for spa jet assemblies of the prior art. It will also be appreciated that installation of the jet assembly of the invention into the tub requires fewer steps than the jet assemblies of the prior art. Moreover, no sealant, such as a gasket, caulking, or o-ring, is required for installation. In addition, by having a jet valve body that can be installed from the rear, the rear portion of the jet valve body can be relatively larger in outer dimension than the inner diameter of the grommet, if desired. Therefore, unlike a fixture assembly which is designed to be entirely installed from the front side (interior side) of a tub or pool, there are relatively few design constraints with respect to the size of the rear portion of the jet valve body.

It will be further appreciated that installation of the hydrotherapy jet assembly into the tub can be managed by a single person. One person may drill the hole, insert the wall grommet into the tub wall through the rear of the tub and insert the jet valve body through the wall grommet. After the jet valve body has been inserted through the rear of the tub wall, the installer can thread the fixture cartridge into the jet valve body from inside the tub. From the foregoing discussion, those skilled in the art will also appreciate that the methods and apparatus are easily adaptable for robotic assembly. A robotic arm facing the exterior of the tub or pool could be programmed to cut a hole in the tub, to then rotate, e.g. 120°, insert a grommet, and then rotate again and insert the jet valve body. Final insertion of the fixture cartridge can then be performed after all other installation processes and/or on-site according to the needs of a particular customer.

Figure 5:
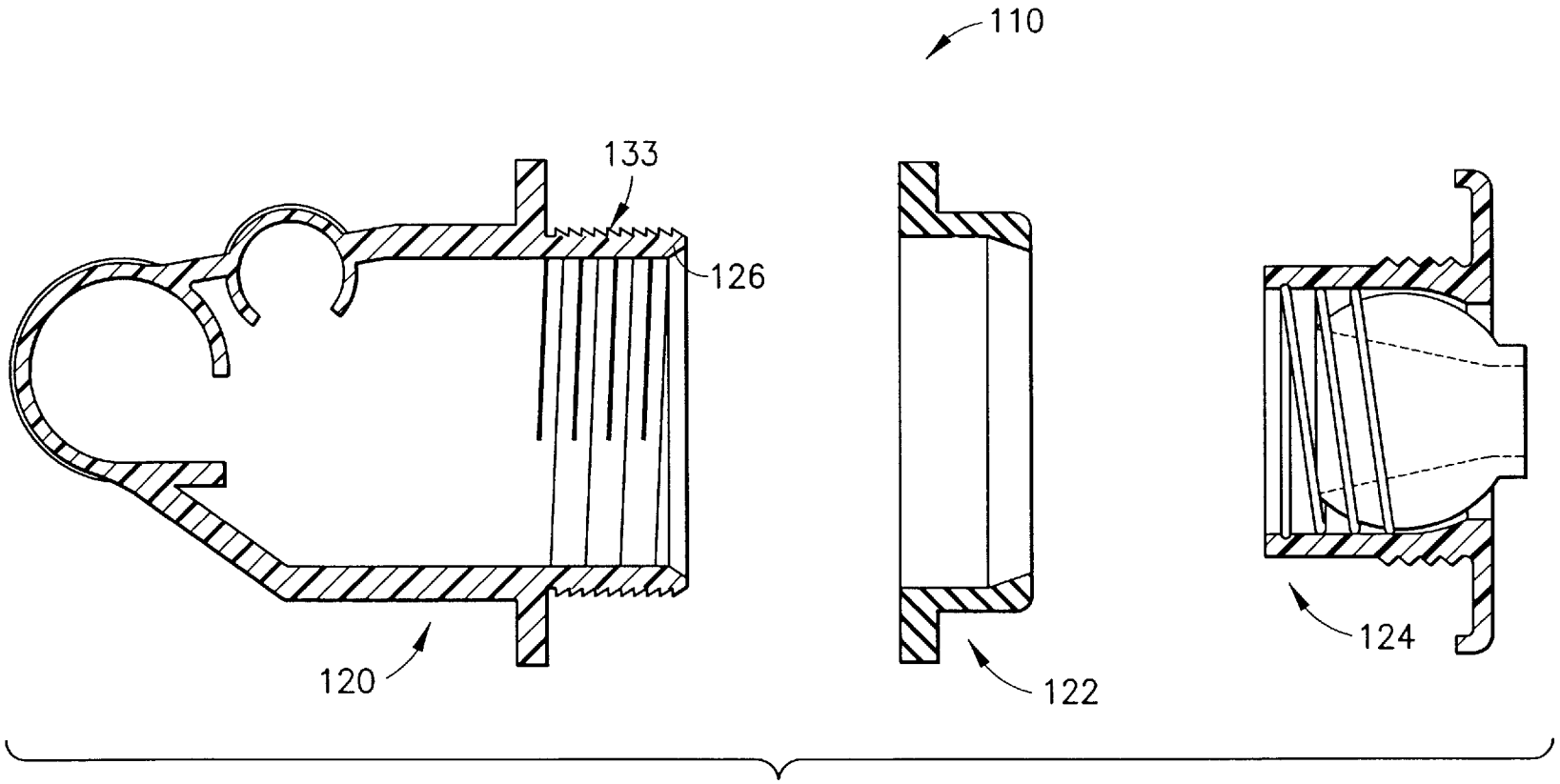
FIG. 5 is an exploded side elevation in section of a tub fixture assembly according to a second embodiment invention.

Referring to FIG. 5, and according to another embodiment of a tub fixture assembly 110, which is substantially similar to the first embodiment (with like parts having numbers incremented by 100), it will be appreciated that the front portion 126 of the jet valve body 120 can be provided with one or more circumferential barbs 133 (or partially circumferential barbs) to assist in joining the jet valve body within the grommet 122 in a watertight fit. The fixture cartridge 124 can then be assembled to the valve body 120 such that it preferably conceals the grommet in the same or a similar manner as in the first embodiment.

Figure 6:
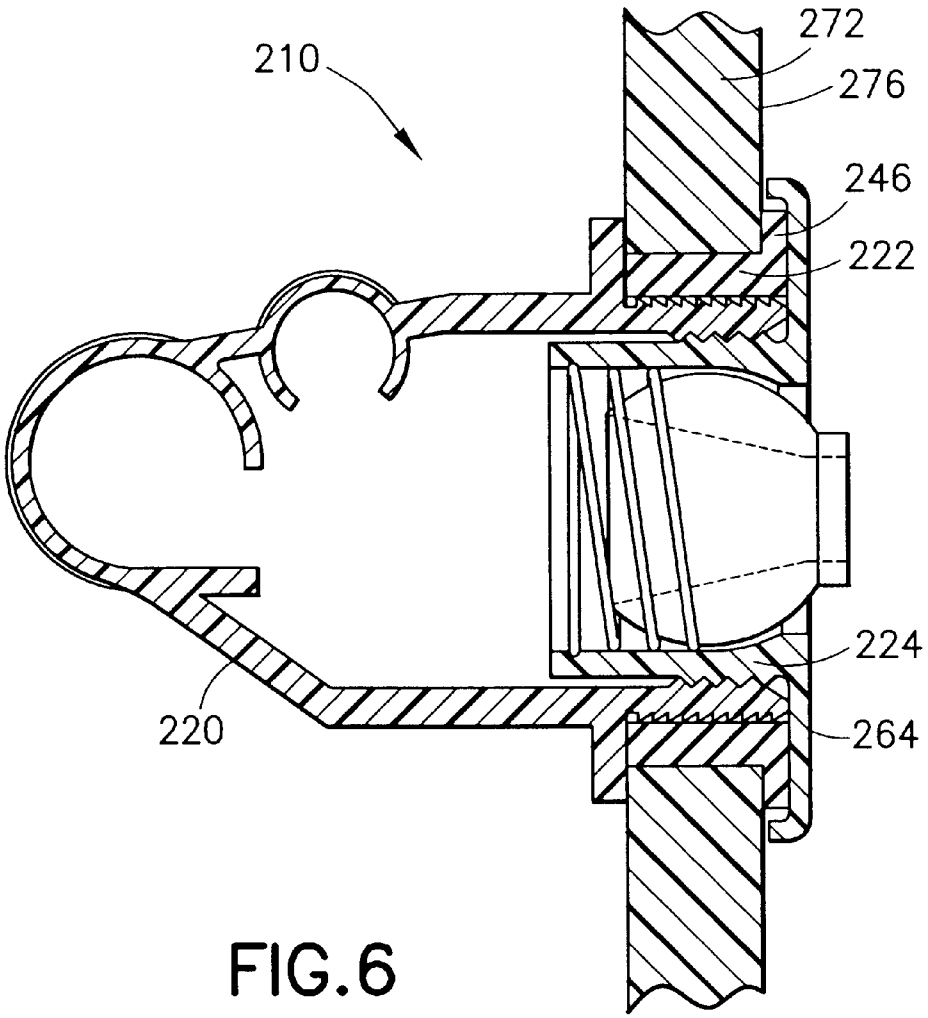
FIG. 6 is a section view of a tub fixture assembly according to a third embodiment of the invention.

Moreover, as shown in FIG. 6 and with reference to a third embodiment of a tub fixture assembly 210, substantially similar to the first embodiment (with like parts having numbers incremented by 200), while it is preferable to install both the jet valve body and the grommet from the rear of the tub wall, it will be appreciated that the grommet 222 may be installed from the front side 276 of the tub wall 272, with the lip 246 of the grommet seating against the front side of the tub wall. The jet valve body 220 is then inserted through the grommet 222. The fixture cartridge 224 is thereafter installed in the valve body 220, preferably such that a cover portion 264 of the fixture cartridge 224 conceals the grommet 222.

Other embodiments of spa tub and pool fixtures are also possible utilizing a wall grommet and a fixture body inserted therethrough to easily create a watertight seal. With reference to application Ser. No. 08/682,432, previously incorporated herein, suction fittings, air controls, valves, power switches, skim filters, and other fixtures can also be installed completely through the rear of the tub wall through a grommet. Likewise, it will be appreciated that cosmetic covers can then be provided from the interior of the tub. Such other fixtures are intended to be within the scope of the invention.

There have been described and illustrated herein hydrotherapy jet assemblies, and methods of installing the same. While several embodiments of the invention have been described, it is not intended that the invention be limited thereto, as it is intended that the invention be as broad in scope as the art will allow and that the specification be read likewise. Therefore, while the jet valve body has been described as being preferably made from schedule #40 PVC, it may also be made from other appropriate materials, such as polyethylene and polypropylene. In addition, while a barbed water conduit, angled perpendicular to the axis of the jet valve body has been described, it will be appreciated that the water conduit may be provided with a different relative angle (the preferable angle for the elbow of the water conduit will best be determined by the location of the water hose relative to the water conduit in a particular installation) or that a separate water fitting may be provided as an intermediary coupling between the jet valve body and a water source. Moreover, the water conduit and air conduit do not necessarily have to be barbed, as other means for connecting the water conduit and air conduit to water and air sources can be used, e.g., various standard plumbing connections, other friction fittings, or glued connections. Also while the peripheral lip on the jet valve body has been shown to be a continuous, it will be appreciated that the lips can be broken. Moreover, radially or non-radially extending posts or other means for preventing the fixture body from completely passing through the grommet can also be used. Furthermore, while the raised bead on the grommet has been disclosed in illustration to appear continuous around the interior circumference of the grommet, it will be appreciated that the bead may be discontinuous. Moreover, as disclosed in the previously incorporated application, round, rectangular, and other shaped fixtures assemblies may also be provided. With respect to the hydrotherapy jet assembly, while the jet valve body has been disclosed as having internal threads for locking with a fixture cartridge, it will be appreciated that other locking means may be used for this purpose, i.e., a snap fit assembly. Furthermore, it will be appreciated that the air conduit may be replaced with a check valve, as disclosed in the previously incorporated application. It will therefore be appreciated by those skilled in the art that yet other modifications could be made to the provided invention without deviating from its spirit and scope as so claimed.

We claim:

1. A watertight fixture assembly for installation in a hole in a wall of a tub or a pool, the wall having interior and exterior sides with the interior side defining the interior of the tub or pool, said fixture assembly comprising:

a) a resilient wall grommet having first and second opposite ends, an outer surface sized to permit said wall grommet to be inserted into the hole, an inner surface, said first end having a first external dimension and said second end having a second external dimension smaller than said first external dimension, said second end sized to be passed into the hole and said first end sized to contact one of the interior side and the exterior side of the wall to prevent said wall grommet from passing completely through the hole;

b) a fixture body having a front portion provided with an outer surface sized to permit said front portion of said fixture body to be inserted into said wall grommet from the exterior side and compress said wall grommet to form a watertight seal between said fixture body and the wall, means for preventing said fixture body from passing completely through said wall grommet, a water conduit, an air inlet means for receiving air, and a nozzle; and c) a fixture cartridge having a body and means for coupling said fixture cartridge at least partially within said fixture body, said fixture cartridge adapted to be coupled to said fixture body from the interior side of the wall.

2. A fixture assembly according to claim 1, wherein:

said grommet has a first end and a second end, a first inner surface diameter at said first end, and a larger second inner surface diameter at said second end.

3. A fixture assembly according to claim 2, wherein:

said means for contacting one of the interior and the exterior side of the wall is a lip provided substantially at said second side of said grommet and having a diameter greater than an outer diameter of said outer surface of said wall grommet.

4. A fixture assembly according to claim 3, wherein:

said fixture body has a front opening and said means for preventing said fixture body from passing completely through said wall grommet is a lip located rearward from said front opening.

5. A fixture assembly according to claim 4, wherein:

said wall grommet is provided with a raised bead along said inner surface and said fixture body is provided with an external groove along said outer surface of said fixture body, such that when said fixture body is seated in said wall grommet said bead engages said groove.

6. A fixture assembly according to claim 4, wherein:

said fixture body is provided with at least one barb extending at least partially around said outer surface, such that when said fixture body is seated in said wall grommet said at least one barb engages said inner surface of said grommet.

7. A fixture assembly according to claim 1, wherein:

said fixture cartridge includes a cover, wherein when said fixture body is inserted in said grommet and said fixture cartridge is coupled at least partially within said fixture body, said cover conceals said grommet and said fixture body when said fixture cartridge is viewed from the interior of the tub or pool.

8. A fixture assembly according to claim 1, wherein:

said fixture cartridge includes a jet valve insert.

9. A fixture assembly according to claim 1, wherein:

said means for coupling said fixture cartridge at least partially within said fixture body comprises internal threads provided on said front portion of said fixture body and external threads on said body of said fixture cartridge.

10. A fixture assembly according to claim 1, wherein:

said wall grommet is provided with a raised bead along said inner surface and said fixture body is provided with external groove along said outer surface of said fixture body, such that when said fixture body is seated in said wall grommet said bead engages said groove.

11. A fixture assembly according to claim 1, wherein:

said fixture body is provided with at least one barb extending at least partially around said outer surface, such that when said fixture body is seated in said wall grommet said at least one barb engages said inner surface of said grommet.

12. A fixture assembly according to claim 11, wherein:

said means for preventing said wall grommet from passing through the hole is a lip having a diameter greater than said outer diameter of said outer surface of said wall grommet.

13. A fixture assembly according to claim 1, wherein:

said fixture body is a jet valve body means for receiving a jet valve insert.

14. A fixture assembly according to claim 1, wherein:

said water conduit has a first entrance and a first axis extending through said first entrance, and said air inlet means is a tubular conduit having a second entrance and a second axis extending through said second entrance, said first and second axes being parallel.

15. A fixture assembly according to claim 14, wherein:

said fixture body has a longitudinal axis, and said first and second axes are oriented generally perpendicular to said longitudinal axis.

16. A fixture assembly according to claim 15, wherein:

said inner surface of said wall grommet is tapered away from said lip.

17. A fixture assembly for installation in a hole provided in a wall of a tub or pool, said fixture assembly installable in a resilient grommet installed in the hole in the wall, the grommet having a structure for preventing the grommet from passing completely through the hole, said fixture assembly comprising:

a) a body having a front portion and a rear portion, said front portion provided with an opening and an outer surface sized to permit said front portion to be inserted into the grommet and compress the grommet against the wall to form a watertight seal between said body and the wall, a water conduit, and an air inlet means for receiving air;

b) means for preventing said body from passing completely through the grommet;

c) a cartridge having jet valve means for directing an aerated water jet, coupling means for coupling said cartridge at least partially within said fixture body, and a cover such that when said body is installed in the grommet, said cover conceals said grommet and said body when said cartridge is viewed from the interior of the tub or pool.

18. A fixture assembly according to claim 17, wherein:

said means for preventing said body from passing completely through the grommet is a lip located rearward of said opening of said front portion.

19. A fixture assembly according to claim 17, wherein:

said cover and said coupling means are a unitary piece of manufacture.

20. A method of installing a watertight fixture assembly into a hole in the wall of a tub or a pool, the wall having an interior side and an exterior side, comprising:

a) from the exterior side of the wall, inserting a resilient grommet into the hole, said grommet having an inner surface, and first and second opposite ends, said first end having a first external dimension and said second end having a second external dimension smaller than said first external dimension, said second end sized to be inserted into the hole and said first end sized to prevent said wall grommet from passing through the hole; and b) from the exterior side of the wall, inserting a fixture body into said grommet, said fixture body having a front portion with an outer surface sized to permit said fixture body to be inserted into said grommet and compress said grommet against the wall to form a watertight seal between said fixture body and the wall, and means for preventing said fixture body from passing through said wall grommet.

21. A method according to claim 20, further comprising:

c) from the interior side of the wall, inserting a fixture cartridge into said fixture body, said fixture cartridge having a cover which conceals said grommet.

22. A method of installing a watertight fixture assembly into a hole in the wall of a tub or a pool, the wall having an interior side and an exterior side, comprising:

a) from the interior side of the wall, inserting a resilient grommet into the hole, said grommet having an inner surface, and first and second opposite ends, said first end having a first external dimension and said second end having a second external dimension smaller than said first external dimension, said second end sized to be inserted into the hole and said first end sized to prevent said wall grommet from passing through the hole; and b) from the exterior side of the wall, inserting a fixture body into said grommet, said fixture body having a front portion with an outer surface sized to permit said fixture body to be inserted into said grommet and compress said grommet against the wall to form a watertight seal between said fixture body and the wall, and means for preventing said fixture body from passing through said wall grommet.

23. A method according to claim 22, further comprising:

c) from the interior side of the wall, inserting a fixture cartridge into said fixture body, said fixture cartridge having a cover which conceals said grommet.

* * * * *